US011852408B2

(12) United States Patent
Tranier et al.

(10) Patent No.: US 11,852,408 B2
(45) Date of Patent: Dec. 26, 2023

(54) METHOD AND APPARATUS FOR SEPARATING AIR BY CRYOGENIC DISTILLATION

(71) Applicant: L'Air Liquide, Societe Anonyme pour l'Etude et l'Exploitation des Procedes Georges Claude, Paris (FR)

(72) Inventors: Jean-Pierre Tranier, Jouy-en-Josas (FR); Richard Dubettier-Grenier, Champigny-sur-Marne (FR); Maxime Rozieres, Champigny-sur-Marne (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 302 days.

(21) Appl. No.: 17/308,750

(22) Filed: May 5, 2021

(65) Prior Publication Data

US 2021/0364233 A1 Nov. 25, 2021

(51) Int. Cl.
*F25J 3/04* (2006.01)

(52) U.S. Cl.
CPC ..... *F25J 3/04412* (2013.01); *F25J 3/04018* (2013.01); *F25J 3/04169* (2013.01);
(Continued)

(58) Field of Classification Search
CPC .. F25J 3/04412; F25J 3/04018; F25J 3/04169; F25J 3/04248; F25J 3/04466; F25J 3/04715; F25J 2200/06; F25J 2200/34; F25J 2210/02; F25J 2220/40; F25J 2230/30; F25J 2230/40; F25J 2240/10; F25J 3/04727;
(Continued)

(56) References Cited

U.S. PATENT DOCUMENTS 4,964,901 A 10/1990 Rhode
5,572,874 A * 11/1996 Rathbone ..... F25J 3/04303 62/924
(Continued)

FOREIGN PATENT DOCUMENTS

CN 102 809 261 B 7/2014
EP 0 952 415 10/1999
(Continued)

OTHER PUBLICATIONS

French Search Report for FR 2 005 220, dated Jan. 28, 2021.

*Primary Examiner* — Miguel A Diaz
*Assistant Examiner* — Ibrahim A. Michael Adeniji
(74) *Attorney, Agent, or Firm* — Justin K. Murray

(57) ABSTRACT

In a method for separating air by cryogenic distillation using a column system consisting of a higher pressure column operating at a first pressure and a lower pressure column operating at a second pressure, a first air flow constituting between 75% and 98% of the air sent to the column system compressed to a third pressure above the first pressure, is sent to the higher pressure column, a second air flow constituting between 5% and 25% of the air sent to the column system is compressed to a fourth pressure above the second pressure but lower than the third pressure, is sent to the lower pressure column, a third column separates an argon-enriched flow and the air sent to the lower pressure column constitutes between 10% and 25% of the total air sent to the column system.

17 Claims, 2 Drawing Sheets

(52) U.S. Cl.
CPC ..... *F25J 3/04248* (2013.01); *F25J 3/04466* (2013.01); *F25J 3/04715* (2013.01); *F25J 2200/06* (2013.01); *F25J 2200/34* (2013.01); *F25J 2210/02* (2013.01); *F25J 2220/40* (2013.01); *F25J 2230/30* (2013.01); *F25J 2230/40* (2013.01); *F25J 2240/10* (2013.01)

(58) Field of Classification Search
CPC .. F25J 3/04733; F25J 2245/40; F25J 2245/58; F25J 2270/90; F25J 2290/12; F25J 3/04218; F25J 3/04496; F25J 2205/32; F25J 2205/34; F25J 2205/62; F25J 3/0409; F25J 3/04157; F25J 3/04296; F25J 3/04303; F25J 3/04387; F25J 3/04393; F25J 3/04678; F25J 3/04957; F25J 3/04969; F25J 3/04054; F25J 3/04448; F25J 3/04896; F25J 5/00; F25J 2215/42; F25J 2215/50; F25J 2215/58; F25J 3/04024; F25J 3/042; F25J 2290/50
USPC ..... 62/644
See application file for complete search history.

(56) References Cited

U.S. PATENT DOCUMENTS

| | | | | |
|---|---|---|---|---|
| 5,657,644 | A * | 8/1997 | Oakey | F25J 3/04296 62/652 |
| 6,269,659 | B1 | 8/2001 | De Bussy et al. | |
| 2020/0080773 | A1* | 3/2020 | Xu | F25J 3/0409 |
| 2021/0055049 | A1* | 2/2021 | Zhao | F25J 3/04181 |

FOREIGN PATENT DOCUMENTS

| | | |
|---|---|---|
| EP | 1 357 342 | 10/2003 |
| JP | S55 38423 | 3/1980 |
| JP | H01 174878 | 7/1989 |
| WO | WO 2013/014252 | 1/2013 |

* cited by examiner

METHOD AND APPARATUS FOR SEPARATING AIR BY CRYOGENIC DISTILLATION

CROSS REFERENCE TO RELATED APPLICATIONS

This application claims the benefit of priority under 35 U.S.C. § 119 (a) and (h) to French patent application No, FR2005220, filed May 20, 2020, the entire contents of which are incorporated herein by reference.

FIELD OF THE INVENTION

The present invention relates to a method and to an apparatus for separating air by cryogenic distillation.

BACKGROUND OF THE INVENTION

All the percentages relating to purities are molar percentages.

It is known to separate air in a column system consisting of a first column operating at a first pressure and a second column operating at a second pressure lower than the first pressure. The overhead gas from the first column is used to heat the bottom of the second column. The second column may be in two sections and may be connected to an argon separation column.

Generally, all the air is compressed to a pressure above the first pressure, cooled by direct contact with water, purified at this pressure and split in two. One fraction is sent to the first column and another fraction is boosted in a booster pump and liquefied by heat exchange with a liquid product of the column system which is vaporized and is sent to the first column and optionally to the second column. In this configuration, there is only a single adsorption unit for purifying to remove water and carbon dioxide and other secondary impurities.

The apparatus is kept cold by a turbine sending gaseous or liquid air to the first column and/or by a turbine sending air to the second column.

U.S. Pat. No. 4,964,901 describes a method where a single air compressor produces air at two different pressures which are purified at these different pressures and sent to the column system.

The method produces oxygen at relatively low purities and does not produce argon.

EP1357342 A1 describes a three-column method with an argon column fed by purified air at two different pressures. The pressures used are substantially greater than those used according to the invention.

SUMMARY OF THE INVENTION

According to certain embodiments of the present invention, by using an argon separation column and with production of pure (>99%, preferably >99.5%) oxygen, surprisingly for those skilled in the art it has been found that an air separation apparatus may nevertheless have a high injection of low-pressure air directly into the low-pressure column of a column system comprising one column operating at a lower pressure than the other.

According to one subject of the invention, a method is provided for separating air by cryogenic distillation using a column system consisting of a first column operating at a first pressure and a second column operating at a second pressure lower than the first pressure, the top of the first column being thermally coupled to the bottom of the second column, in which:

i) a first air flow constituting between 75% and 98% of the air sent to the column system is compressed to a third pressure between 5 and 6 bar abs and above the first pressure, cooled and sent at the third pressure to a first adsorption unit in order to be purified of water and of carbon dioxide and the purified first flow is sent to the first column and optionally to the second column;

ii) a second air flow constituting between 2% and 25%, or even 5% and 25%, of the air sent to the column system is compressed to a fourth pressure between 1.2 and 2 bar abs and above the second pressure but lower than the third pressure, preferably cooled by direct contact in an air cooling tower, sent at the fourth pressure to a second adsorption unit in order to be purified of water and of carbon dioxide and the purified second flow is sent to the second column;

iii) air is separated in the first column to form an oxygen-enriched liquid and a nitrogen-enriched gas;

iv) oxygen-enriched liquid and nitrogen-enriched liquid are sent from the first column to the second column;

v) a liquid with a purity of greater than 99%, preferably 99.5% of oxygen is drawn off from the column system, pressurized and then vaporized by heat exchange with at least one portion of the first air flow;

vi) an argon-enriched gas is sent from the second column to a third column and an argon-rich fluid is drawn off at the top of the third column;

vii) air sent to the second column constitutes between 10% and 25% of the total air sent to the column system; and viii) the argon-rich fluid contains between 20% and 80% of the argon contained in the first and second air flows.

According to other, optional aspects:

the argon-rich fluid contains between 45% and 75% of the argon contained in the first and second air flows;

the oxygen yield of the apparatus is greater than 95%;

the first air flow is cooled by direct contact with a first flow of water in a first cooling tower and the second air flow is cooled by direct contact with a second flow of water in a second cooling tower, nitrogen gas originating from the column system is sent to a water cooling tower and the cooled water in the water cooling tower is sent to the first and second air cooling towers;

the cooled water is cooled between the water cooling tower and the second air cooling tower so that the water sent to the second air cooling tower is colder than that sent to the first air cooling tower;

the air is cooled in the first air cooling tower to a temperature at least 5° C., preferably at least 8° C., above the temperature to which the air is cooled in the second air cooling tower;

the air is cooled in the first cooling tower to a temperature at most 30° C., preferably at most 12° C., above the temperature to which the air is cooled in the second cooling tower;

the first purified flow is cooled upstream of the column system in a first heat exchanger by heat exchange with a first nitrogen gas flow originating from the column system and the second purified flow is cooled upstream of the column system in a second heat exchanger by heat exchange with a second nitrogen gas flow originating from the column system;

the second purified flow is cooled upstream of the column system in the second heat exchanger by heat exchange with only the second nitrogen gas flow originating from the column system;

the second nitrogen flow is introduced into the second heat exchanger at a temperature without being passed through another heat exchanger after it has left the column;

the first purified flow is cooled upstream of the column system in the first heat exchanger by heat exchange with the first nitrogen gas flow originating from the column system and also with pressurized liquid drawn off from the column system and the liquid is vaporized in the first heat exchanger;

the second air flow is not expanded or boosted between the second adsorption unit and the second column;

at least one portion of the first air flow is not expanded or boosted between the first adsorption unit and the first column;

a portion of the first air flow is boosted then expanded between the first adsorption unit and the first column;

a portion of the first air flow is expanded in a turbine then sent to the first column in gaseous and/or liquid form;

at least 14 mol % of the total air is sent to the second column;

the purified second flow is sent to the second column in order to be separated at the same level of the column as a flow of oxygen-enriched liquid originating from the first column;

the purified second flow is sent to the second column in order to be separated at the same level of the column as a flow of oxygen-enriched liquid originating from the first column and vaporized in an overhead condenser of the third column;

the whole of the purified first flow is sent to the first column and optionally to the second column;

the whole of the purified second flow is sent to the second column;

the whole of the nitrogen gas drawn off at the top of the second column is heated by heat exchange with air;

the column system does not comprise a column operating at a pressure lower than that of the second column; and/or the third pressure is between 5 and 6 bars abs.

According to another subject of the invention, an apparatus is provided for separating air by cryogenic distillation using a column system consisting of a first column operating at a first pressure and a second column operating at a second pressure lower than the first pressure, the top of the first column being thermally coupled to the bottom of the second column, a first adsorption unit, a second adsorption unit, means for sending a first air flow constituting between 75% and 98% of the air sent to the column system, compressed to a third pressure above the first pressure, to cooling means and then, at the third pressure, to the first adsorption unit in order to be purified of water and of carbon dioxide and means for sending the whole of the purified first flow to the first column and optionally to the second column, means for sending a second air flow constituting between 5% and 25% of the air sent to the column system, compressed to a fourth pressure between 1.2 and 2 bar abs and above the second pressure but lower than the third pressure, at the fourth pressure, to the second adsorption unit in order to be purified of water and of carbon dioxide and means for sending the whole of the purified second flow to the second column, the first column comprising heat and mass exchange means in order to separate the air to form an oxygen-enriched liquid and a nitrogen-enriched gas, means for sending oxygen-enriched liquid and nitrogen-enriched liquid from the first column to the second column, means for drawing off a liquid with a purity of greater than 99%, preferably 99.5% of oxygen from the column system, a pump for pressurizing this liquid, means for vaporizing the pressurized liquid by heat exchange with at least one portion of the first air flow and means for sending an argon-enriched gas from the second column to the third column and means for drawing off an argon-rich fluid at the top of the third column.

Preferably, the column system comprises only the first and second columns.

BRIEF DESCRIPTION OF THE DRAWINGS

Further features and advantages of the invention will become apparent from the description hereinafter of embodiments, which are given by way of illustration but without any limitation, the description being given in relation with the following attached figures.

DETAILED DESCRIPTION OF THE INVENTION

Figure 1:
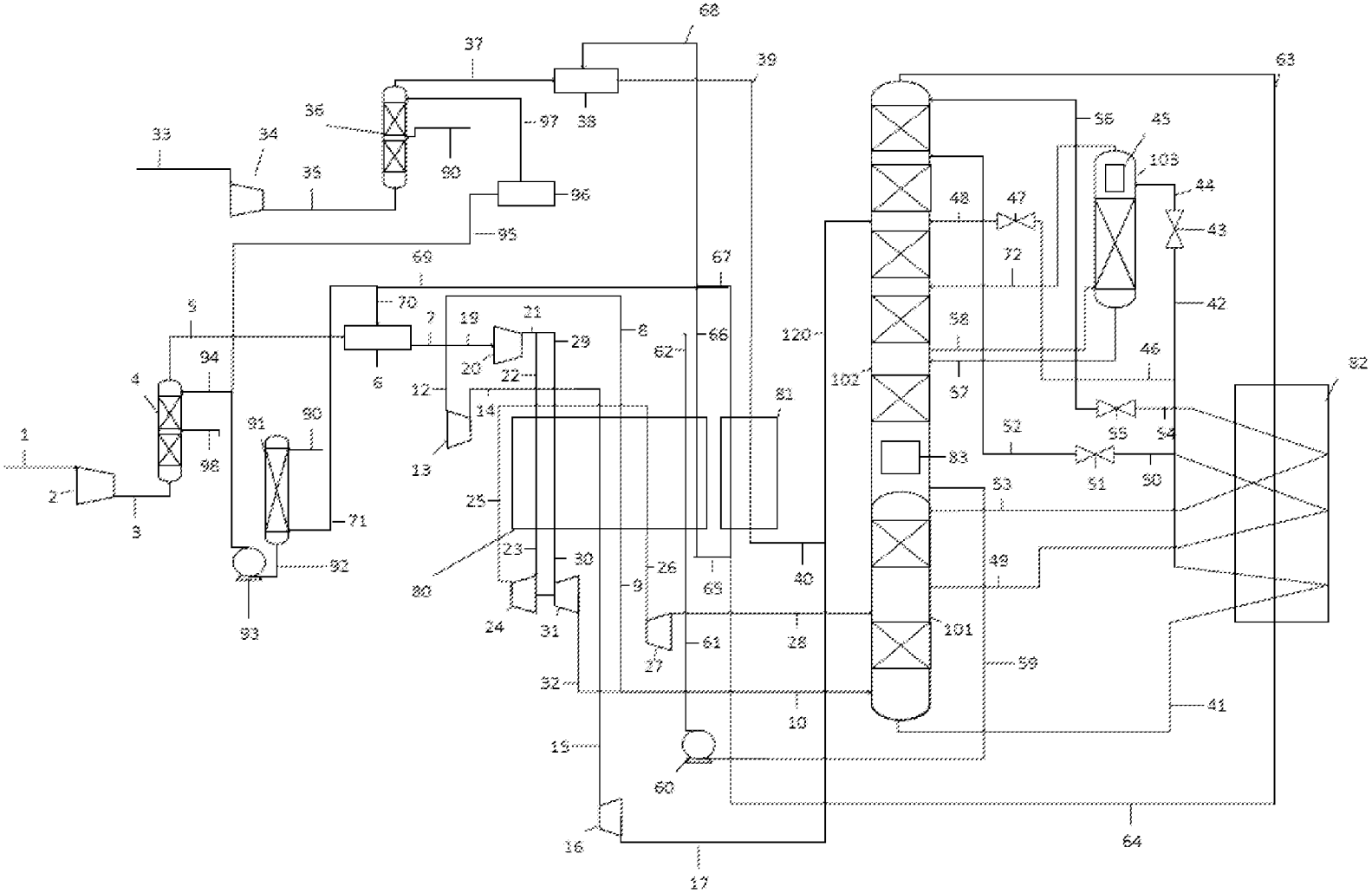
FIG. 1 illustrates an air separation apparatus according to the invention.

FIG. 1 shows that a first air flow 1 constituting between 75% and 98% of the total air sent to the column system is compressed from atmospheric pressure down to a pressure slightly above the pressure of a first column 101. The difference between the pressure of the first column and the pressure of the air 3 compressed in the compressor 2 corresponds to the pressure drop due to the cooling and purification which take place after the compression and before entry into the column. Other means for cooling the air 35 may be envisaged, for example refrigeration units.

The air 3 may therefore be at between 5 and 6 bar abs and is sent to a first cooling tower 4 supplied at the top with water 94 and at an intermediate level with water 98.

The cooled air 5 drawn off at the top of the tower 4 is sent to a first adsorption unit 6 in order to remove the water and carbon dioxide that it contains. The purified air 7 is divided into three portions. One portion 8 is cooled in the gaseous state in the first heat exchanger 80 and enters the column 101 in gaseous form mixed with the air 32 to form the flow 10.

Another portion 12 is boosted in a booster pump 13 to form a boosted flow 14 which is cooled in the first exchanger 80 to form a cooled flow 15 extracted at an intermediate temperature level from the exchanger. This flow 15 is expanded in a turbine 16 to form a gas 17 at the pressure of the second column 102 and is sent to the column 102.

Another portion 19 is boosted in a booster pump 20 to form the flow 21 and then is split into two fractions. One fraction 22 is cooled in the first exchanger 80, extracted at an intermediate temperature level (typically around −120° C., not illustrated), is boosted in a cold booster pump 24, is reintroduced into the exchanger 80, is cooled in the exchanger 80 and is expanded in the turbine 27 to form a liquid 28 (or optionally a two-phase mixture) which is sent to the first column 101.

The other fraction 29 is cooled in the exchanger 80 and is extracted at an intermediate temperature level (not illustrated) to form a flow 30 which is expanded in a turbine 31 coupled to the cold booster pump 24. The expanded air 32 is at the pressure of the first column 101.

A second air flow 33 constituting between 5% and 25%, preferably more than 10%, of the total air sent to the column system is compressed from atmospheric pressure down to a pressure slightly above the pressure of a second column 102. The difference between the pressure of the second column and the pressure of the air 35 compressed in the compressor 34 corresponds to the pressure drop due to the cooling and purification which take place after the compression and before entry into the column 102.

The air 35 is at between 1.2 and 2 bar abs and is sent to a second cooling tower 36 supplied at the top with water 97 and at an intermediate level with water 90. The cooled air 37 drawn off at the top of the tower 36 is sent to a second adsorption unit 38 in order to remove the water and carbon dioxide that it contains. Other means for cooling the air 35 may be envisaged, for example refrigeration units. The use of a tower is nevertheless preferred for air at lower pressure in order to reduce the associated pressure drops. The purified air 39 is cooled in the gaseous state in the first heat exchanger 81 to form the flow 40 and enters the column 101 in gaseous form mixed with the air 17 to form the flow 120. The flow 120 represents between 3% and 5% of the total flow of air. The air flow 120 is sent to the second column 102 to be separated at the same level of the column as the expanded bottom liquid 48 and above the inlet of vaporized rich liquid 72.

Thus the flow 40 sent to the second column 102 represents between 5% and 25% of the total air, preferably more than 10% of the total air sent to the column system. In total, the flow 120 represents between 10% and 25% of the total air sent to the column system, being a mixture of the flow 40 and the blown air 17.

Figure 2:
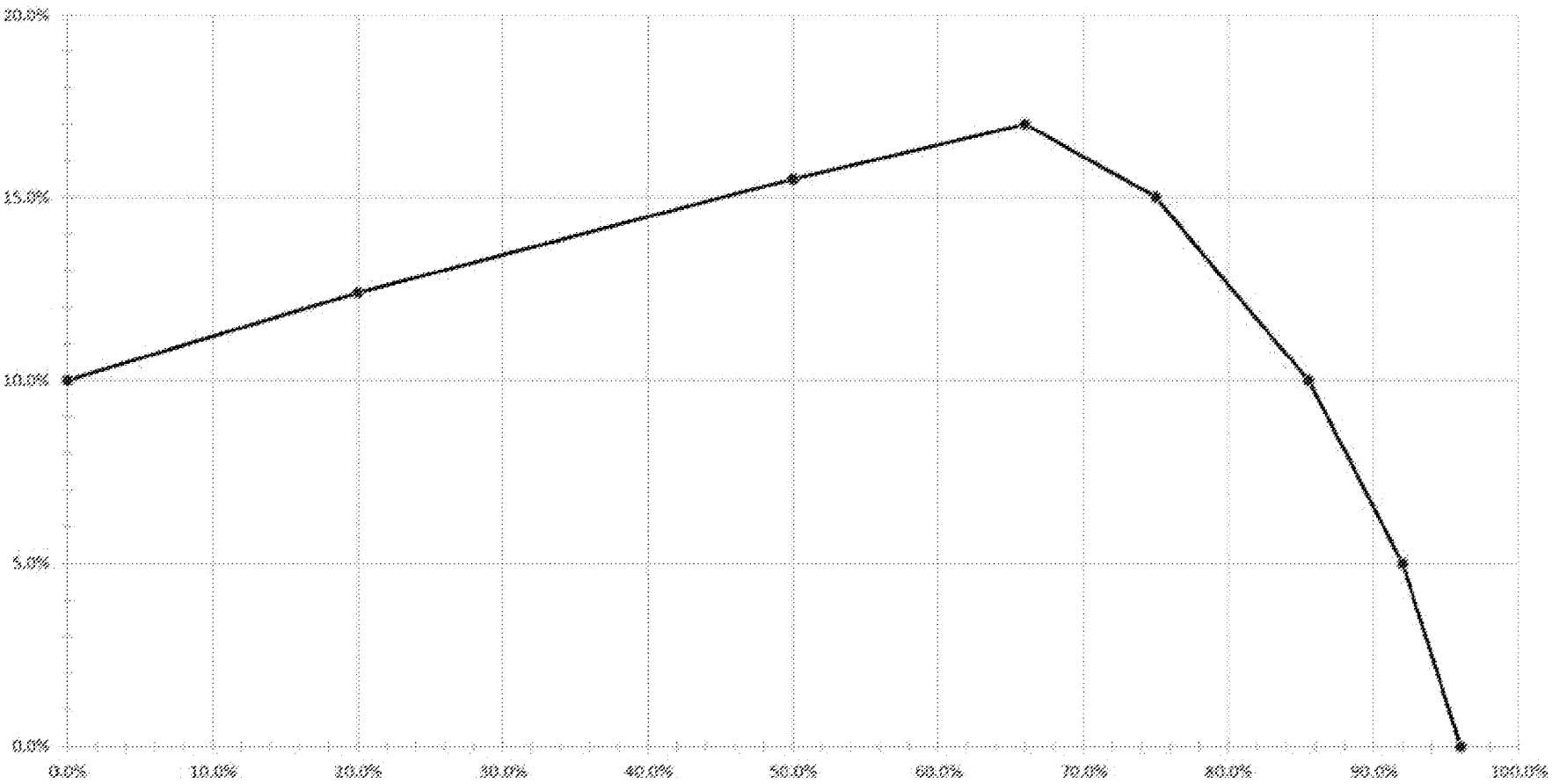
FIG. 2 illustrates, at a constant oxygen purity of 99.5% and at a constant oxygen yield of 99%, the percentage of the total feed air on the y-axis that can be injected directly into a second column as a function of the argon yield of the unit on the x-axis.

Given that the oxygen is produced at a purity of more than 99% and preferably greater than 99.5%, it is surprising that it is possible to send this high percentage of air to the second column 102 without significantly degrading the oxygen yield of the unit. U.S. Pat. No. 4,964,901 did not for that matter envisage it. If argon is not produced, it is not actually possible to inject such an amount of air into the low-pressure column while seeking to produce oxygen at a purity of more than 99% preferably greater than 99.5%. In the same way, if argon is produced while seeking this time to obtain a "conventional" argon yield lying in modern apparatus around 85% and a good oxygen yield (of the order of 99%), this is not possible either. It is while producing argon from a third column, preferably with a yield around 65%, that it was possible to simultaneously obtain a production of oxygen at a purity of more than 99% and preferably greater than 99.5% with a good oxygen yield typically around 99% (at least greater than 95%). FIG. 2 illustrates, at a constant oxygen purity of 99.5% and at a constant oxygen yield of 99%, the amount of air, in terms of percentage of the total flow of air sent to the distillation, that can be injected directly into the second column 102 as a function of the argon yield of the unit on the x-axis.

The oxygen yield is defined by the amount of oxygen contained in the oxygen productions that may be gaseous and/or liquid divided by the amount of oxygen contained in all of the air flows introduced into the apparatus.

It is observed that the maximum percentage of air to be sent to the second column lies around the point of the 65% yield for argon.

The argon from the third column is either mixed with residual nitrogen, or produced in liquid or gaseous form after having passed through a denitrogenation column.

To combat global warming, it is necessary to improve the energy efficiency of apparatuses for separating the air gases. In the configuration considered, the more air is injected into the low-pressure second column, the less energy the unit will consume. By adding a third column, referred to as an argon mixture column, and by operating it at an optimum argon yield preferably at around 65% without necessarily producing this argon, the energy consumption of the apparatus can be minimized. A column system consists of a first column 101 operating at a first pressure and a second column 102 operating at a second pressure lower than the first pressure. The overhead gas from the first column is used to heat the bottom of the second column. The second column may be in two sections and may be connected to an argon separation column.

The air is separated by distillation in the first column 101 in order to produce an oxygen-enriched bottom liquid 41, a nitrogen-enriched overhead liquid 53 and a nitrogen-enriched intermediate liquid 49. The liquids 53, 49 are cooled in a subcooler 82 to form the liquids 54, 50 and are expanded by the valves 55, 51 respectively before being sent to the second column 102.

The oxygen-enriched liquid is divided into two portions 42, 46. The portion 46 is expanded in a valve 47 and sent as flow 48 to the second column 102. The portion 42 is expanded in the valve 43 and is sent as liquid 44 to an overhead condenser 45 of an argon separation column 103.

Nitrogen gas from the top of the column 101 is condensed in the bottom reboiler 83 of the second column 102 in order to heat the bottom of the second column. The condensed nitrogen is sent back to the top of the first column 101 and the top of the second column 102.

The argon separation column 103 is supplied with gas by a flow 58 taken at an intermediate level from the low-pressure column 102. The bottom liquid 57 from the column 103 is sent back to the column 102. An argon-rich fluid is drawn off from the top of the column 103 containing at least 95%, or even at least 98% argon. The fluid may contain around 2% oxygen and be mixed thereafter with nitrogen gas from the column system or purified by catalysis. Or else the fluid may contain less than 2 ppm of oxygen and be used as a product after having passed through a denitrogenation column (not represented in the diagram).

Liquid oxygen 59 containing at least 99% oxygen, preferably at least 99.5% oxygen, is drawn from the bottom of the second column 102, pressurized by a pump 60 and sent as pressurized flow 61 to the heat exchanger 80 where it is completely vaporized to form the main product of the apparatus, oxygen gas 62 at a pressure of at least 10 bar a. Lower pressures may be envisaged.

The overhead gas 63 from the column 102 is heated in the subcooler 82 then is split into two. One portion 67 is heated in the second heat exchanger 81 and the remainder 65 is heated in the first heat exchanger 80. The flow 65 heated is the flow 66 and is used to regenerate the second adsorption unit 38 as flow 68. It is also possible to split the overhead gas 63 from the column 102 into two portions before being introduced into the subcooler 82. In this case, the portion 67 which is heated in the second heat exchanger 81 is introduced into said exchanger at a lower temperature which makes it possible to cool the fluid 40 to a lower temperature and, after mixing with the fluid 17 to form the fluid 120, to introduce it into the second column 102 at a temperature closer to the prevailing temperature in this column at the injection point, which makes it possible to decrease the irreversibilities of the process.

The flow 67, 69 is used in part 70 to regenerate the first adsorption unit 6 and in part 71 to cool the water in the water cooling tower 91. Water 90 is sent to the top of the column and leaves cooled 92 at the bottom in order to be sent via a pump 93 to the two air cooling towers 4, 36.

Thus, the two air cooling towers 4, 36 are supplied with cooling water originating from a single water cooling tower 91 cooled by nitrogen originating from the column system.

The water 95 intended for the second air cooling tower 36 is cooled between the water cooling tower 91 and the second tower 36 by a cooler 96 for example a refrigeration unit in order to cool the water to a temperature between 5° C. and 30° C. below the temperature of the water 94 arriving at the top of the first tower 4, preferably between 8° C. and 15° C. below this temperature.

It is also possible to use two water cooling towers, each supplying the respective air cooling tower with water at the required temperature. In this case, the cooling tower producing cooled water intended to cool the second air cooling tower should be supplied with nitrogen 67 originating from the second heat exchanger 81 since it is colder than the nitrogen 62 originating from the first heat exchanger 80.

Thus, the second heat exchanger 81 carries out a heat exchange between just two fluids, air 39, 40 and nitrogen 67.

The second compressor and the second adsorption unit could be added to an existing apparatus having the first compressor and the first adsorption unit in order to surpass the production limits of the existing apparatus.

The purified second flow 120 is sent to the second column 102 in order to be separated at the same level of the column as a flow of oxygen-enriched liquid originating from the first column (not illustrated) or as a flow of oxygen-enriched liquid originating from the first column and vaporized in an overhead condenser of the third column, flow 72.

The argon-rich fluid produced at the top of column 103 contains between 20% and 80% of the argon contained in the first and second air flows 1, 33, preferably between 45% and 75%.

The oxygen yield of the apparatus is greater than 95%.

The air 20 sent to the second column constitutes between 10% and 25%, or even between 14% and 25%, of the total air sent to the column system.

If the second flow 33 is at its minimum of 5% of the total flow, the remaining at least 5% of the air intended for the second column will be part of the first flow 1 and at least 5% of the total air will be expanded in the blowing turbine 16 so that the air flow sent to the second column is at least 10% of the total air.

It may be envisaged to carry out the process with two different operations. In a first operation, during the periods where energy is not very expensive, the air is compressed exclusively in the compressor 2 and the flow 33 does not exist. The second column is supplied with air by the turbine 16 exclusively. During this operation, at least one liquid product, for example liquid nitrogen, is produced and can be stored and optionally used in part as product.

In a second operation, the air is compressed in the compressors 2 and 34 and preferably the air flow sent to the compressor 2 will be reduced relative to the flow during the first operation. During the second operation, energy is more expensive and therefore the operating costs are reduced by lowering the amount of air compressed to the highest pressure. The apparatus will be kept cold in part by sending liquid nitrogen produced during the first operation.

As used herein, means for sending/transferring/transporting/feeding/etc. . . . a fluid is understood to include one or more conduits and the like that are configured to transfer fluids from one location to another location.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

We claim:

1. A method for separating air by cryogenic distillation using a column system comprising of a higher pressure column operating at a first pressure and a lower pressure column operating at a second pressure lower than the first pressure, the top of the higher pressure column being thermally coupled to the bottom of the lower pressure column, in which:

i. compressing a first air flow constituting between 75% and 98% of the air sent to the column system to a third pressure above the first pressure, and then cooling and sending the first air flow at the third pressure to a first adsorption unit in order to be purified of water and of carbon dioxide and the purified first flow before sending at least a first portion of first air flow to the higher pressure column and optionally to the lower pressure column;

ii. compressing a second air flow constituting between 2% and 25% of the air sent to the column system to a fourth pressure between 1.2 and 2 bar abs and above the second pressure but lower than the third pressure, preferably cooled by direct contact in an air cooling tower, and then sending at the fourth pressure to a second adsorption unit in order to be purified of water and of carbon dioxide and the purified second flow before being sent to the lower pressure column;

iii. separating air in the higher pressure column to form an oxygen-enriched liquid and a nitrogen-enriched gas;

iv. sending the oxygen-enriched liquid and the nitrogen-enriched liquid from the higher pressure column to the lower pressure column;

v. withdrawing a liquid with a purity of greater than 99% of oxygen from the column system, pressurizing the liquid in a pump and then vaporizing said liquid by heat exchange with at least one portion of the first air flow;

vi. sending an argon-enriched gas from the lower pressure column to a third column and withdrawing an argon-rich fluid at the top of the third column; and vii. sending air the lower pressure column constitutes between 10% and 25% of the total air sent to the column system;

wherein the argon-rich fluid contains between 20% and 80% of the argon contained in the first and second air flows.

2. The method according to claim 1, wherein the argon-rich fluid contains between 45% and 75% of the argon contained in the first and second air flows.

3. The method according to claim 1, wherein the oxygen yield of the apparatus is greater than 95%.

4. The method according to claim 1, wherein the first air flow is cooled by direct contact with a first flow of water in a first cooling tower and the second air flow is cooled by direct contact with a second flow of water in a second cooling tower, nitrogen gas originating from the column system is sent to a water cooling tower and the cooled water in the water cooling tower is sent to the first and second air cooling towers.

5. The method according to claim 4, wherein the cooled water is cooled between the water cooling tower and the second air cooling tower so that the water sent to the second air cooling tower is colder than that sent to the first air cooling tower.

6. The method according to claim 4, wherein the air is cooled in the first air cooling tower to a temperature at least 5° C. above the temperature to which the air is cooled in the second air cooling tower.

7. The method according to claim 4, wherein the air is cooled in the first cooling tower to a temperature at most 30° C., preferably at most 12° C., above the temperature to which the air is cooled in the second cooling tower.

8. The method according to claim 1, wherein the first purified flow is cooled upstream of the column system in a first heat exchanger by heat exchange with a first nitrogen gas flow originating from the column system and the second purified flow is cooled upstream of the column system in a second heat exchanger by heat exchange with a second nitrogen gas flow originating from the column system.

9. The method according to claim 8, wherein the second purified flow is cooled upstream of the column system in the second heat exchanger by heat exchange with only the second nitrogen gas flow originating from the column system.

10. The method according to claim 8, wherein the second nitrogen flow is introduced into the second heat exchanger at a temperature without being passed through another heat exchanger after it has left the column.

11. The method according to claim 1, wherein the second air flow is not expanded or boosted between the second adsorption unit and the lower pressure column.

12. The method according to claim 1, wherein at least one portion of the first air flow is not expanded or boosted between the first adsorption unit and the higher pressure column.

13. The method according to claim 1, wherein a portion of the first air flow is boosted then expanded between the first adsorption unit and the higher pressure column.

14. The method according to claim 1, wherein a portion of the first air flow is expanded in a turbine then sent to the higher pressure column in gaseous and/or liquid form.

15. The method according to claim 1, wherein at least 14 mol % of the total air is sent to the lower pressure column.

16. The method according to claim 1, wherein the purified second flow is sent to the lower pressure column in order to be separated at the same level of the column as a flow of oxygen-enriched liquid originating from the higher pressure column or as a flow of oxygen-enriched liquid originating from the higher pressure column and vaporized in an overhead condenser of the third column.

17. An apparatus for separating air by cryogenic distillation using a column system comprising a higher pressure column operating at a first pressure and a lower pressure column operating at a second pressure lower than the first pressure, the top of the higher pressure column being thermally coupled to the bottom of the lower pressure column, a first adsorption unit, a second adsorption unit, means for sending a first air flow constituting between 75% and 98% of the air sent to the column system, compressed to a third pressure above the first pressure, to cooling means and then, at the third pressure, to the first adsorption unit in order to be purified of water and of carbon dioxide and means for sending the whole of the purified first flow to the higher pressure column and optionally to the lower pressure column, means for sending a second air flow constituting between 2% and 25% of the air sent to the column system, compressed to a fourth pressure between 1.2 and 2 bar abs and above the second pressure but lower than the third pressure, at the fourth pressure, to the second adsorption unit in order to be purified of water and of carbon dioxide and means for sending the whole of the purified second flow to the lower pressure column, the higher pressure column comprising heat and mass exchange means in order to separate the air to form an oxygen-enriched liquid and a nitrogen-enriched gas, means for sending oxygen-enriched liquid and nitrogen-enriched liquid from the higher pressure column to the lower pressure column, means for drawing off a liquid with a purity of greater than 99%, preferably 99.5% of oxygen from the column system, a pump for pressurizing this liquid, means for vaporizing the pressurized liquid by heat exchange with at least one portion of the first air flow and means for sending an argon-enriched gas from the lower pressure column to the third column and means for drawing off an argon-rich fluid at the top of the third column.

* * * * *